US009904202B2

(12) United States Patent
Matsukawa et al.

(10) Patent No.: US 9,904,202 B2
(45) Date of Patent: Feb. 27, 2018

(54) IMAGE FORMING APPARATUS HAVING POTENTIAL DIFFERENCE CONTROL

(71) Applicant: CANON KABUSHIKI KAISHA, Tokyo (JP)

(72) Inventors: Akihisa Matsukawa, Fuchu (JP); Kuniaki Tamagaki, Kawasaki (JP); Takanori Watanabe, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/259,196

(22) Filed: Sep. 8, 2016

(65) Prior Publication Data

US 2017/0075249 A1 Mar. 16, 2017

(30) Foreign Application Priority Data

Sep. 15, 2015 (JP) ..... 2015-182090

(51) Int. Cl.
*G03G 15/02* (2006.01)
*G03G 21/00* (2006.01)
*G03G 15/23* (2006.01)

(52) U.S. Cl.
CPC ..... *G03G 15/0266* (2013.01); *G03G 15/235* (2013.01); *G03G 21/0005* (2013.01); *G03G 21/0064* (2013.01)

(58) Field of Classification Search
USPC ..... 399/50, 149, 150, 397, 401
See application file for complete search history.

(56) References Cited

U.S. PATENT DOCUMENTS 5,864,736 A * 1/1999 Shimada ..... G03G 21/0064 399/149
7,251,441 B2 7/2007 Hagiwara et al.
9,429,868 B2 8/2016 Usui et al.
2006/0216090 A1 9/2006 Murakami et al.
2008/0069590 A1* 3/2008 Shigehiro ..... G03G 21/0064 399/149
2009/0297183 A1 12/2009 Miyahara
2016/0252841 A1 9/2016 Goto et al.

FOREIGN PATENT DOCUMENTS

JP 2003-173053 A 6/2003
JP 2005-283845 A 10/2005

OTHER PUBLICATIONS

European Search Report dated Feb. 9, 2017, in related European Patent Application No. 16188540.5.

* cited by examiner

*Primary Examiner* — Hoan Tran
(74) *Attorney, Agent, or Firm* — Fitzpatrick, Cella, Harper & Scinto

(57) ABSTRACT

In an image forming apparatus configured such that developer remaining on an image bearing member without being transferred to a recording material is moved from the image bearing member to a developer bearing member and then recovered in a developer storage portion 35. When forming a second image on a rear surface of the recording material having a surface on which a first image is fixed with a fixing device, a second potential difference between surface potential of the image bearing member after charging with a charging member when forming the second image and potential of the developer bearing member is less than a first potential difference when forming a first image.

13 Claims, 2 Drawing Sheets

IMAGE FORMING APPARATUS HAVING POTENTIAL DIFFERENCE CONTROL

BACKGROUND OF THE INVENTION

Field of the Invention

The present invention relates to an image forming apparatus for forming an image on a recording material by an electrophotographic process.

Description of the Related Art

Conventionally, for image forming apparatuses for forming images on a recording material using toner (developer) such as electrophotographic apparatuses or electrostatic recording apparatuses, a cleanerless system (toner recycle system) has been proposed from a viewpoint of simplification of an apparatus configuration and elimination of waste. The system eliminates an exclusive drum cleaner, which is surface cleaning means after a transfer step of a photosensitive drum, moves transfer residual toner on the photosensitive drum after transfer to a development roller during a developing step to remove it from the photosensitive drum, and recovers the residual toner in a development device and reuses the same. The simultaneous developing/cleaning for removing residual toner on a photosensitive drum during a developing step is a method of recovering the residual toner on the photosensitive drum after a transfer step by toner recovery bias for recovering in a developing step at an image formation step or later. The toner recovery bias is a fog removing potential difference Vback, which is a potential difference between a DC voltage applied to a development roller (developer bearing member) and surface potential of the photosensitive drum (image bearing member). According to the method, since the transfer residual toner is recovered in the development device and reused in the next step or later, work such as disposing the waste toner and such becomes unnecessary and troublesome maintenance can be reduced. Since it is cleanerless, it is advantageous in terms of space and the image forming apparatus can be significantly downsized.

In an image forming apparatus using the simultaneous developing/cleaning system, it is important to reduce the transfer residual toner on the photosensitive drum after a transfer step, completely recover the toner to the development device in a developing step, and prevent the toner from appearing in the next image formation. Because, there is a possibility in which not all transfer residual toner on the photosensitive drum after a transfer step cannot be recovered in a developing step and a recovery residue ghost image or a toner scattering image appears.

For instance, in Japanese Patent No. 4510493, a mono component magnetic contact development system is proposed as a development device adopting the simultaneous developing/cleaning. The system is to perform development by carrying magnetic developer (magnetic toner) on a development sleeve (developer bearing member) containing magnetic field generating means and bringing it into contact with a surface of the photosensitive drum.

In Japanese Patent Application Publication No. 2003-173053, it is proposed, in a development device adopting the simultaneous developing/cleaning, to reduce an absolute value of a developing bias in image formation on a rear face to be smaller than in image formation on a front face so as to reduce an influence of a change in the moisture content of a recording material on the image quality.

When both side image formation is performed, transferability changes between a front face (a recording material that does not pass a fixing device) of the recording material and a rear face (a recording material that once passed the fixing device). With the above-described conventional configuration, there is a case where white background fogging becomes worse and a change in recovery residue ghost occurs caused by a change in transferability in both side image formation, and the image quality becomes unstable. In recent years, with requirement for saving paper use being on the rise to conserve resources, duplex printing has become more prevalent. This presents an important challenge to address since high image quality is required also in both side image formations.

SUMMARY OF THE INVENTION

The present invention aims at providing a technology capable of stabilizing the quality of formed images when images are formed on both surfaces of the recording material.

To accomplish the object, an image forming apparatus according to the present invention comprising:

an image bearing member;

a charging member configured to charge the image bearing member;

a developer bearing member configured to carry a developer for forming a developer image by developing an electrostatic image on the image bearing member;

a developer storage portion configured to store the developer to be carried by the developer bearing member;

a transfer portion configured to transfer the developer image, formed on the image bearing member, onto a recording material;

a fixing device configured to fix the developer image on the recording material; and a control portion configured to implement control such that, in a case that (I) the developer remaining on the image bearing member without being transferred to the recording material is moved from the image bearing member to the developer bearing member and then recovered in the developer storage portion and (II) a second image is formed on a rear face of the recording material after a first image is formed on a surface of the recording material and the first image is fixed by the fixing device, (i) a second potential difference between (i-1) a surface potential of the image bearing member after being charged with the charging member when forming the second image and (i-2) a potential of the developer bearing member is less than (ii) a first potential difference between (ii-1) a surface potential of the image bearing member after being charged with the charging member when forming the first image and (ii-2) a potential of the developer bearing member.

Further features of the present invention will become apparent from the following description of exemplary embodiments (with reference to the attached drawings).

DESCRIPTION OF THE EMBODIMENTS

The following provides a detailed exemplary explanation of embodiments of this invention based on examples with reference to the drawings. However, the dimensions, materials, shapes and relative arrangement of constituent components described in the embodiments may be suitably modified according the configuration and various conditions of the apparatus to which the invention is applied. Namely, the scope of this invention is not intended to be limited to the following embodiments.

EXAMPLE 1

Figure 1:
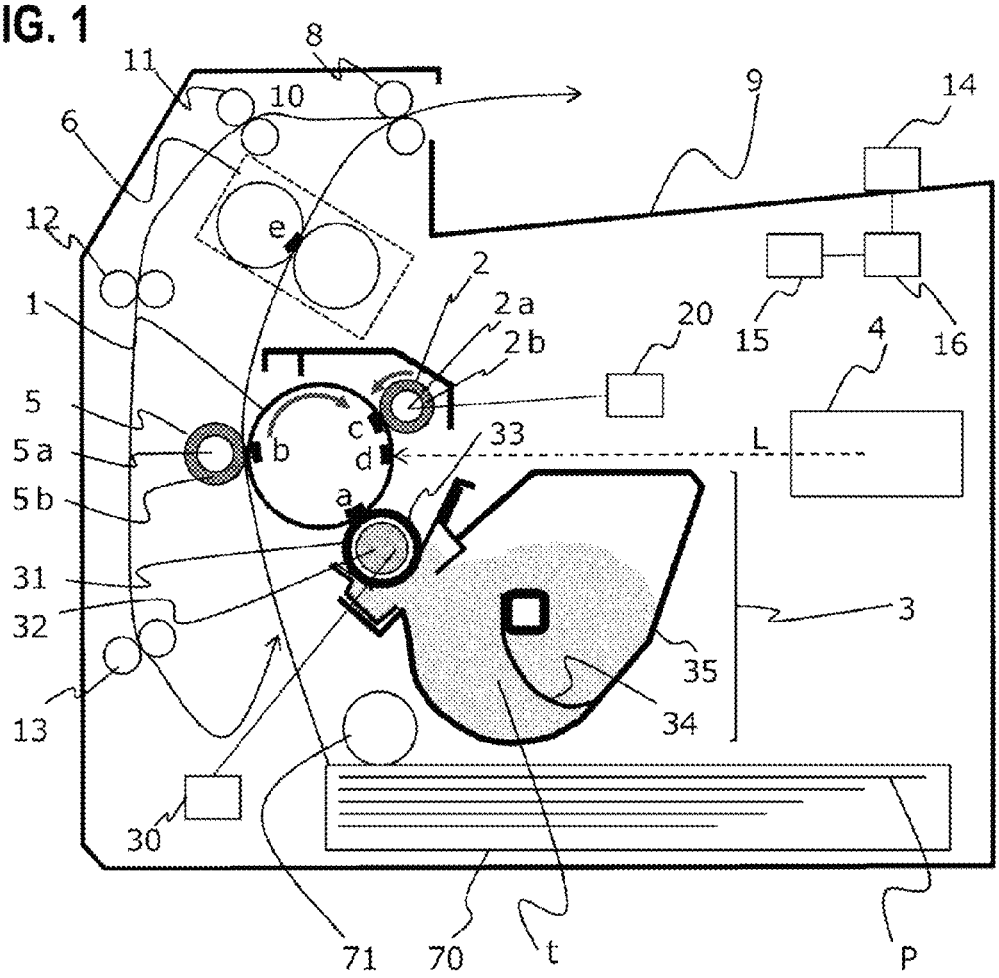
FIG. 1 is a schematic cross-sectional view of an image forming apparatus related to an example of the present invention.

FIG. 1 is a schematic cross-sectional view illustrating an outline configuration of an image forming apparatus associated with an example of the present invention. The image forming apparatus is a monochromatic laser printer using a transfer type electrophotographic process. A photosensitive drum 1, which is an image bearing member, is a negative polarity OPC photoreceptor of ϕ24 mm in this example. The photosensitive drum 1 is a rotary body that is rotationally driven at a constant speed of a circumferential speed of 100 mm/sec (=process speed PS, image formation speed) in a clockwise direction represented by an arrow in the figure. FIG. 1 is a view when viewed along an axial direction of the photosensitive drum, which is an image bearing member, and is a cross-section vertical to the axis line.

A charging roller 2, which is a charging member, includes a conductive elastic layer 2*b* at an outer circumference of a core metal 2*a*, and a member for charging a surface of the photosensitive drum 1, which is an image bearing member surface. The charging roller 2 is brought into pressure contact with the photosensitive drum 1 with a predetermined pressing force, and forms a charging nip portion c between the photosensitive drum 1. In the present example, the charging roller 2 is rotationally driven in a direction opposite to the rotation direction of the photosensitive drum 1. Therefore, an area facing the photosensitive drum 1 on a surface of the charging roller 2 moves in the same direction as a surface of the photosensitive drum 1.

A charging power supply 20 as voltage application means (first voltage application portion) for applying a charge bias to the charging roller 2 applies a DC voltage to the core metal 2*a* of the charging roller 2. The charging power supply 20 is a power-supply circuit for generating a desired power output from power supplied (input) from a commercial power supply outside of the apparatus and supplying the power to the core metal 2*a*. The applied DC voltage is set at such a value so that potential difference between the surface of the photosensitive drum 1 and the charging roller 2 is greater than or equal to a discharge starting voltage, and specifically, a DC voltage of −1250 V is applied as a charge bias. With the voltage application, the surface area of the photosensitive drum 1 brought into contact with the charging roller 2 is uniformly charged at a charge potential (dark part potential) of Vd=−650 V.

The image forming apparatus includes a laser beam scanner 4 including a laser diode, a polygon mirror, and such as exposure means, which is means for forming in the charged image bearing member an electrostatic latent image. The laser beam scanner 4 outputs a laser beam whose intensity is modulated in accordance with a time series electric digital pixel signal of target image information, and performs scanning exposure L with the laser beam on the uniformly charged surface of the photosensitive drum 1. The laser beam scanner 4 is so configured that, when the entire uniformly charged processed surface of the photosensitive drum 1 is exposed with a laser beam, the laser power is adjusted so that the drum surface potential (potential of an area where the laser irradiating position d is passed at the surface of the photosensitive drum 1) after exposure satisfies Vl=−100 V.

A development device 3, which is development means of the present example, supplies an electrostatic latent image (electrostatic image) formed on the photosensitive drum 1, which is an image bearing member, with developer (toner) t to form a developer image (toner image). The development device 3 includes a development sleeve 31, which is a developer bearing member carrying the developer. To the development sleeve 31, a developing bias (Vdc) −300 V is applied from a developing bias power supply 30, which is voltage application means (second voltage application portion). The developing bias power supply 30 is a power-supply circuit for supplying the development sleeve 31 with power by generating a desired power output from power supplied (input) from a commercial power supply outside of the apparatus. In many cases, a transformer is used. With the application of the developing bias, an electrostatic latent image is developed into a developer image in the surface area of the photosensitive drum 1 facing the development sleeve 31.

The development sleeve 31, which is a development roller rotatably supported by a frame body of the development device 3, is rotationally driven with respect to the photosensitive drum 1 at a circumferential speed of 140% with a drive power transmitted from a driving source such as an unillustrated motor. In other words, the development sleeve 31 is rotated at a speed faster than the photosensitive drum 1 in a direction opposite to the rotation direction of the photosensitive drum 1. Therefore, the area in the surface of the development sleeve 31 facing the photosensitive drum 1 moves in the same direction as the surface of the photosensitive drum 1 and its moving speed is relatively faster than the speed of the surface of the photosensitive drum 1.

The development sleeve 31 is provided with a conductive elastic rubber layer around a hollow aluminum raw pipe. A surface of the conductive elastic rubber layer has surface roughness of Ra 1.0 to 2.0 mm for developer transportation. Inside the hollow of the development sleeve 31, a magnet roller 32 is disposed and fixed. A magnetic mono component black developer (negative charging property) T, which is a developer in the development device 3, is stirred with a stirring member 34 inside a toner chamber 35 (developer storage portion) in the frame body. With the stirring, the developer T is supplied to the surface of the development sleeve 31 with a magnetic force of the magnet roller inside the developing unit 3. In the present example, the developer of the toner chamber 35 is pumped up with the stirring member and supplied to the development chamber through an opening of the development chamber. Therefore, a bottom portion of the development chamber is located at a position higher than the bottom portion of the toner chamber in a gravity direction (vertical direction in FIG. 1). As illustrated in FIG. 1, from the bottom portion of the image forming apparatus upward, components are disposed in the following order of a rotating shaft of the stirring member, a bottom portion (most bottom portion) of the development sleeve, an abutting portion of the development sleeve and the photosensitive drum, an exposure position of the photosensitive drum surface, and a charging position to the photosensitive drum, which is a charging member. The developer supplied to the surface of the development sleeve 31 is made to be a uniform thin layer by passing through a developing blade 33 and is charged to be negative polarity with triboelectric charging. Then, the developer is transported to a development nip portion a, which is in contact with the photosensitive drum 1, and the electrostatic latent image is developed. In the present example, although the magnetic mono component black developer is used, a two-component developer may be used depending on a configuration and a color other than black is acceptable.

The stirring member is rotated with a sheet member being mounted to the stirring rotating shaft. A rotation direction of the stirring member is opposite to the rotation direction of the development sleeve. A free end of the sheet member of the stirring member is brought into contact with a development sleeve surface while stirring. When viewed at the contact point, a movement direction of the free end of the stirring member and a movement direction of the development sleeve surface are the same. Thus, by being into contact with each other, a paper powder residing on the development sleeve can be efficiently dropped, which leads to stabilization of the image.

As a member constituting a transfer portion for transferring the developer image developed by development means to a recording material, a transfer roller 5 (transfer member) of intermediate resistance is disposed so as to be pressed to the photosensitive drum 1 with a predetermined pressure contact force. Thus, a transfer nip portion b is formed between the transfer roller 5 and the photosensitive drum 1. The transfer roller 5 used in the present example includes an intermediate resistance foam layer 5*b* formed on a core metal 5*a*. The transfer roller 5 has a roller resistance value of $5\times10^{8}\Omega$. A voltage of +2.0 kV is applied to the core metal 5*a* for transfer.

As fixing means, a fixing device 6 of a heat fixing system is disposed downstream of the transfer nip portion b in a transfer path of a recording material P. The recording material P such as a copy sheet transported with a feeding roller 71 from a paper feeding cassette 70 at a predetermined timing passes through the transfer nip portion b, receives transfer of toner image and is separated from the surface of the photosensitive drum 1, and is introduced to a fixing nip portion e of the fixing device 6. Then the recording material P is heated and pressed at the fixing nip portion e, and ejected out of the apparatus (paper ejection tray 9) as an image formation object (print copy).

The image forming apparatus associated with the present example is constituted so as to be capable of executing a single-surface image formation mode for printing only on one surface of the recording material P and a both-surface image formation mode for printing both surfaces of the recording material P. The image forming apparatus associated with the present example includes: an operation portion 14 (input portion for inputting various commands) with which a user executes various operations to the apparatus; an engine control portion 15 for controlling operations of apparatuses of various configurations; and a printer controller 16 (control portion). The printer controller 16 includes various calculation portions and a storage portion, and in accordance with the content of commands, generates control amounts required for various operations of the apparatus and outputs to the engine control portion 15. The engine control portion 15 operates each configuration of the apparatus according to an output from the printer controller 16.

In the case where image formation to the recording material P is only for one surface (when the single-surface image formation mode is specified), the recording material P image-fixed at the fixing device 6 is ejected with a paper ejection roller 8 to the paper ejection tray 9 to complete the image formation. On the other hand, in the case where the image formation to the recording material P is for both surfaces (when the both-surface image formation mode is specified), at a timing when a rear end portion of the recording material P, on which a single surface image (first image) is formed, ejected from the fixing device 6, reaches the paper ejection roller 8, the ejection roller 8 is reversely rotated. Thereby, the recording material P is switchback-transported into the image forming apparatus from the paper ejection tray 9 side (a transportation direction is switched to the opposite direction). The recording material P switched back and transported by reverse rotation of the paper ejection roller 8 is introduced into a both-surface transportation path 10. The recording material P is transported through the both-surface transportation path 10 with both-surface transportation rollers 11, 12, 13, and re-transported to the transfer nip portion b again at a predetermined timing in a state where front and rear surfaces are reversed. Thus, the recording material P receives the transfer of the toner image for the second side (rear face). Then, the recording material P, similar to the case of the single-surface image formation mode, is image-fixed with the fixing roller 6 (formation of the second image), and ejected with the paper ejection roller 8 to the paper ejection tray 9 (completion of image formation).

An image forming apparatus to which the present invention is applicable is not limited to an image forming apparatus having a mechanism for automatically performing image formation on both surfaces of the recording material P as the above-described example. The problem of the present invention can occur also for an image forming apparatus for performing image formation only on one surface of the recording material P. That is a case where, for instance, a user flips a front and a rear surface of a sheet on one of which an image is formed and the user specifies the second side, sets the sheet on the image forming apparatus to perform image formation on the other surface. In other words, when, in an image forming apparatus for performing image formation only on one surface, a configuration is such that, with specification of a both-surface printing mode being input to an operation portion 14 by a user, a control portion can recognize that image formation to be performed is for a second side, the present invention can be applicable.

A cleanerless system of the present example will be described in details. In the present example, the transfer residual developer remaining on the image bearing member after transferring with the transfer means is made to be recovered with the development means during the development. In other words, a so called a cleanerless system is adopted in which a cleaning member for removing from the photosensitive drum 1 the transfer residual toner remaining on the photosensitive drum 1 without being transferred is not provided.

The transfer residual toner remaining on the photosensitive drum 1 after a transfer step is charged to negative polarity, similarly to the photosensitive drum 1, with discharge generated at a gap portion in front of the abutting portion (charging nip portion c) of the charging roller 2 and the photosensitive drum 1. At this time, the surface of the photosensitive drum 1 is charged to −650V. The transfer residual toner charged to negative polarity passes through the charging roller 2 without being adhered thereto at the charging nip portion c owing to a potential difference relation (photosensitive drum surface potential=−650 V, charging roller potential=−1200 V).

The transfer residual toner passing through the charging nip c reaches a laser irradiating position d. Since the transfer residual toner is not so plenty as to shield a laser beam of the laser beam scanner 4, a step of forming an electrostatic latent image on the photosensitive drum 1 is not influenced.

Among toner passing the laser irradiating position d, toner on an area (non-exposed portion) which did not receive laser irradiation on the drum surface is recovered in the development sleeve 31 (development potential=−300 V) by electrostatic power at the development nip portion a. On the other hand, among toner passing the laser irradiating position d, toner on an area (exposed area) which received laser irradiation on the drum surface is not recovered in the development sleeve 31 by electrostatic power, and remains on the photosensitive drum 1. Part of the toner may be recovered with a physical force caused by a circumferential speed difference between the development sleeve 31 and the photosensitive drum 1. Since the residual toner on the exposure portion remains by such an amount as to give almost no influence on the exposure for the next image formation, it is no problem even when the residual toner remains on the photosensitive drum 1 without being recovered in the development sleeve 31.

Figure 2:
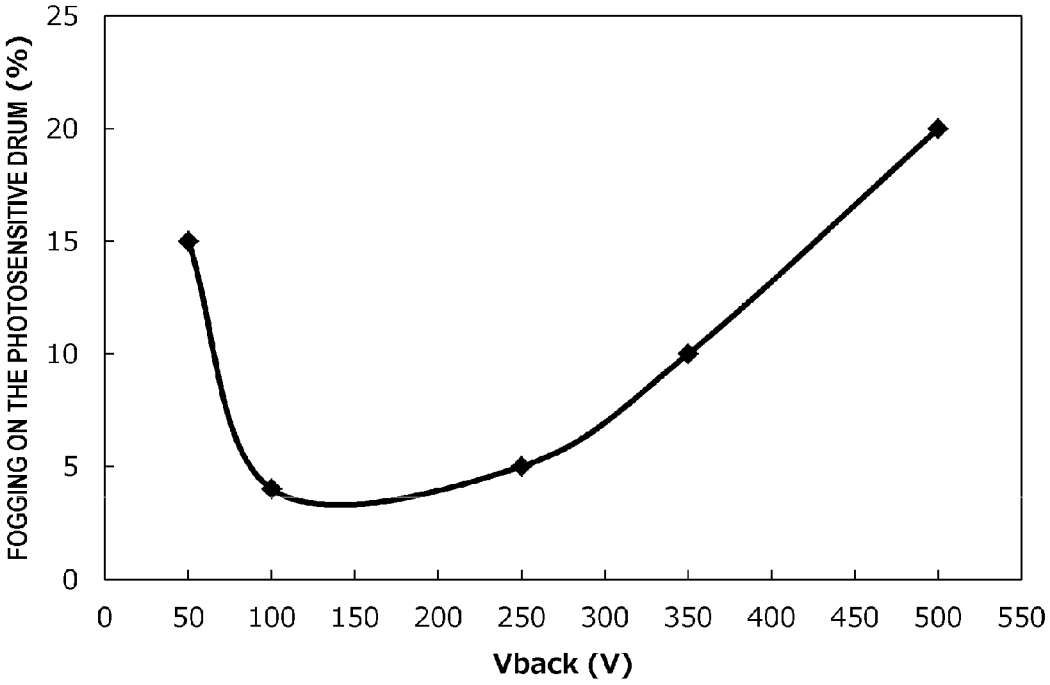
FIG. 2 is a view illustrating a relation between Vback and fogging on a photosensitive drum.

In this case, since the potential applied to the development sleeve 31 is −300 V, the potential difference (Vback) from the surface potential=−650 V of the photosensitive drum 1 after charging is 350 V. As Vback increases, the recovery properties of the transfer residual toner are improved. However, when Vback becomes too large, reversal fogging becomes worse as illustrated in FIG. 2. Thus, merely increasing Vback is not necessarily preferable. FIG. 2 is a graph illustrating a relation between Vback (V) at a measurement environment 32.5 C/80% (temperature/humidity) and a fogging amount generated on the photosensitive drum. It can be understood that the fogging becomes minimum at a certain Vback, and the fogging becomes worse when Vback becomes larger or smaller. Sometimes, fogging at Vback smaller than the Vback at which the fogging becomes the minimum is called as normal fogging, and fogging at Vback larger than the Vback at which the fogging becomes the minimum is called as reversal fogging. Particularly, under a high temperature/high humidity environment, worsening of reversal fogging when Vback is increased becomes significant.

Measurement of the fogging amount is performed in the following method. The fogging on the photosensitive drum 1 is taped with a transparent polyester tape and pasted on a sheet, Commercial 4200 made by Xerox Corporation, and reflection density is measured with a reflection density meter made by GretagMacbeth (today's X-Rite Inc.), which is quantified as a fogging amount. At the measurement, a measured value of a part where a tape is simply pasted to a sheet is made to be a reference value and is subtracted. For instance, when the reference value is 80 and the measured value is 60, the fogging amount becomes 20(%).

As described above, toner remaining on the photosensitive drum 1 without being transferred to the recording material P is mostly recovered in the developing unit 3. The toner recovered in the developing unit 3 is used by being mixed with the toner remaining in the developing unit 3.

In the present example, a configuration is described in which, in order to make the transfer residual toner pass the charging nip portion c without being adhered to the charging roller 2, the charging roller 2 is rotationally driven by providing a predetermined circumferential speed difference from the photosensitive drum 1, and a surface of the charging roller 2 is moved faster than a surface of the photosensitive drum 1 at the charging nip portion c. By rotationally driving the charging roller 2 and the photosensitive drum 1 by providing a predetermined circumferential speed difference, it becomes possible to make such toner to be of negative polarity owing to rubbing between the photosensitive drum 1 and the charging roller 2. Thus, an effect of suppressing adhesion of the toner to the charging roller 2 is exerted. In the configuration of the present example, the core metal 2*a* of the charging roller 2 is provided with an unillustrated charging roller gear, and the charging roller gear is engaged with an unillustrated drum gear provided at an end portion of the photosensitive drum 1. Therefore, along with the photosensitive drum 1 being rotationally driven, the charging roller 2 is also rotationally driven. The circumferential speed of the surface of the charging roller 2 is set so as to be 115% of the circumferential speed of the surface of the photosensitive drum 1.

Advantageous points of Example 1 of the present invention will be described by comparing with Comparison Examples. Comparison results of image formation between Example 1 and Comparison Example 1, Comparison Example 2 are shown in Table 1 below. In the case where image formation is performed twice for the front surface and the rear surface of the recording material in a both side image formation, first image formation to the recording material is made to be for a first side and second image formation to the recording material is made to be for a second side. The environmental conditions for image formation are made to be temperature of 32.5 C and humidity of 80%.

TABLE 1

| | Image forming surface | Vback (Recovery bias) | Fogging on the photosensitive drum | Fogging on the recording material | Transfer residue (m/s) | Recovery residue ghost |
|---|---|---|---|---|---|---|
| Example 1 | For a 1st side | 350 | 10% | ○1% | 0.8 | ○ |
| | For a 2nd side | 250 | 5% | ○1.5% | 0.4 | ○ |
| Comparison Example 1 (Vback constant) | For a 1st side | 350 | 10% | ○1% | 0.8 | ○ |
| | For a 2nd side | 350 | 10% | Δ4% | 0.4 | ○ |
| Comparison Example 2 (Vback constant) | For a 1st side | 250 | 5% | ○0.7% | 0.6 | Δ |
| | For a 2nd side | 250 | 5% | ○1.2% | 0.4 | ○ |

In Example 1, in the image formation for the first side, photosensitive drum surface potential Vd=−650 V, charging roller potential=−1250 V, and development potential Vdc=−300 V are set. Drum surface potential Vl=−100 V is set for a case where the entire surface of a uniformly charged processed surface of the photosensitive drum 1 is exposed with a laser beam. Therefore, recovery bias Vback=350 V and development contrast=200 V are resulted. Although fogging on the photosensitive drum in this case is 10%, since the transferability for the first side is low, the fogging on the recording material is low by 1% or so, and since the recovery bias is sufficiently large for the transfer residual toner, ghost caused by the recovery residual toner was not generated.

For the image formation for the second side (recording material passing the fixing device), photosensitive drum surface potential Vd=−550 V, charging roller potential=−1150 V, development potential Vdc=−300 V are set. Drum surface potential Vl=−100 V is set for a case where the entire surface of a uniformly charged processed surface of the photosensitive drum 1 is exposed with the laser beam. Therefore, recovery bias Vback=250 V and development contrast=200 V are resulted. Fogging on the photosensitive drum in this case becomes 5% by the reversal fogging being suppressed. Since a surface of the recording material that passed the fixing device once and is subjected to heat and pressure becomes smooth and a contact area between the toner and the recording material is increased, the toner on the photosensitive drum becomes easier to be mechanically scrubbed. However, even if the fogging toner becomes easier to be transferred to the recording material, since an amount of the toner is small in the first place, a level of the fogging is 1.5% or so, and it is not a problem. Although the recovery bias becomes as small as 250 V, since the amount of the transfer residual toner is small for the recording material for the second side, it can be sufficiently recovered, and excellent image quality can be secured for the first side and for the second side.

In Comparison Example 1, similar to conventional ones, a configuration is described in which recovery biases are both constant for the first surface and for the second surface. In Comparison Example 1, photosensitive drum surface potential Vd=−650 V, charging roller potential=−1250 V, and development potential Vdc=−300 V are set. Drum surface potential Vl=−100 V is set for a case where the entire surface of a uniformly charged processed surface of the photosensitive drum 1 is exposed with the laser beam. Therefore, recovery bias Vback=350 V and development contrast=200 V are resulted. Fogging on the photosensitive drum in this case becomes 10%. For the first side, it is possible to obtain excellent image quality similar to Example 1. However, for the second side, owing to the surface of the recording material that once passed the fixing device becoming smooth, the residual toner is transferred to the recording material. Therefore, a large proportion of 10% fogging on the drum is transferred to the recording material and fogging on the recording material becomes 4%, whereby generation of image failures is resulted.

Comparison Example 2 is a configuration in which recovery biases for the first side and the second side are made to be smaller than the recovery biases in the Comparison Example 1 so as to suppress reversal fogging on the drum, and recovery biases are constant for both first and second surfaces. In the Comparison Example 2, concerning image formation of the second side, excellent image quality is secured, since the configuration is similar to Example 1. Although, in the image formation of the first side, since fogging on the photosensitive drum is small, fogging on the recording material becomes excellent, since the recovery bias (Vback) is small, the transfer residual toner cannot be completely recovered, which results in occurrence of recovery residue ghost.

<Effect of the Present Example>

As described in Example 1, by making a recovery bias (Vback) for the second side to be smaller than a recovery bias for the first side to optimize the recovery biases, image quality for the first side and for the second side can be stabilized and image failures such as white background fogging and recovery residue ghost can be suppressed.

Although, in the present example, Vback for the first side of 350 V is reduced by 100 V to Vback for the second side of 250 V, the reduction amount of Vback is not limited to this value and can be set appropriately according to apparatus configurations or conditions. It is acceptable if the value is such a value as to suppress a fogging amount on the photosensitive drum for the second side compared to that for the first side by a predetermined degree (in the present example, 10% reduced to 5% (Table 1)). For instance, the reduction amount can be set in a range of 10 to 50% for Vback for the first side (in the present example, reduction amount of about 30%). It is more preferable in the present example to set at Vback smaller than Vback when an image is formed on the first side by a degree in a range of 25 to 35%.

A setting value for Vback may be changed according to a kind of a recording material. In the present example, for a recording material P, a letter size Business 4200 (basis weight: 75 g/m$^2$) made by Xerox Corporation is used. For instance, in the case where a sheet surface has high smoothness such as a cardboard, since an amount of fogging becomes large and an amount of the transfer residual toner tends to be reduced, it is acceptable to set Vback at a value smaller than in the case of plain paper (for instance, 300 V for the first side, 200 V for the second side).

Although, as a method of changing Vback for the first side and for the second side, in the present example, only the charge bias is changed, it is acceptable, for instance, to change Vback by changing the development potential in a range where a predetermined development contrast can be maintained. In this case, by making a magnitude of developing bias at a time of forming the second side to be larger than that at a time of forming the first side, a configuration is made so as to form a desired Vback. It is also acceptable to change Vback by changing both of the charge bias and the development potential. It is also acceptable to change Vback by changing pre-exposure potential, in an apparatus configuration including pre-exposure means for exposing the photosensitive drum surface after transfer before charging.

The development device described so far may have a configuration in which it is detachable to an apparatus body of the image forming apparatus. It is also acceptable, of course, to have a configuration in which, while the development device is fixed to the image forming apparatus, and only a developer container storing the developer is detachable. It is also acceptable to have a configuration in which, while the development device is detachable, an image bearing member unit having an image bearing member is also detachable.

Similarly, a configuration is also usable in which a process cartridge is detachable to the image forming apparatus. Although it is acceptable if the process cartridge at least includes an image bearing member, in the configuration of the present example, a photosensitive drum, which is an image bearing member, a charging roller, which is a charging member, a development sleeve, which is a developer bearing member, and a development storage portion for storing a developer are included.

Although, in the present example, an image forming apparatus of a configuration in which a toner image (developer image) formed on the photosensitive drum is directly transferred to the recording material, which is a body to be transferred, is described, in application of the present invention, the configuration of the image forming apparatus is not particularly limited. For instance, the present invention is also applicable to an image forming apparatus (color laser printer and such) in which a color toner image is formed by superposing and transferring toner images, having different colors, formed at a plurality of image formation portions onto an intermediate transfer belt, which is a body to be transferred and transfer it to a recording material. In other words, the image forming apparatus includes a transfer portion constituted of a first transfer member for transferring a toner image to an intermediate transfer body and a second transfer member for transferring the toner image from the intermediate transfer body to a recording material.

According to the present invention, it is possible to stabilize the quality of a formed image in the case of forming images on both surfaces of a recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. JP2015-182090, filed Sep. 15, 2015, which is hereby incorporated by reference herein in its entirety.

What is claimed is:

1. An image forming apparatus comprising:

an image bearing member;

a charging member configured to charge the image bearing member;

a developer bearing member configured to carry a developer for forming a developer image by developing an electrostatic image on the image bearing member;

a developer storage portion configured to store the developer to be carried by the developer bearing member;

a transfer portion configured to transfer the developer image, formed on the image bearing member, onto a recording material;

a fixing device configured to fix the developer image on the recording material; and a control portion configured to implement control such that, in a case that (I) the developer remaining on the image bearing member without being transferred to the recording material is moved from the image bearing member to the developer bearing member and then recovered in the developer storage portion, and (II) a second image is formed on a rear face of the recording material after a first image is formed on a surface of the recording material and the first image is fixed by the fixing device, (i) a second potential difference between (i-1) a surface potential of the image bearing member after being charged with the charging member when forming the second image and (i-2) a potential of the developer bearing member is less than (ii) a first potential difference between (ii-1) a surface potential of the image bearing member after being charged with the charging member when forming the first image and (ii-2) a potential of the developer bearing member.

2. The image forming apparatus according to claim 1, further comprising a first voltage application portion configured to apply a voltage to the charging member, wherein the control portion implements control to the first voltage application portion such that an absolute value of a voltage applied by the first voltage application portion to the charging member when forming the second image is smaller than an absolute value of a voltage applied by the first voltage application portion to the charging member when forming the first image.

3. The image forming apparatus according to claim 1, further comprising a second voltage application portion configured to apply a voltage to the developer bearing member, wherein the potential difference is a potential difference between surface potential of the image bearing member after charging and potential of the developer bearing member formed by voltage application with the second voltage application portion.

4. The image forming apparatus according to claim 1, wherein the control portion implements control such that an absolute value of surface potential of the image bearing member after charging when forming the second image is smaller than an absolute value of surface potential of the image bearing member after charging when forming the first image.

5. The image forming apparatus according to claim 1, wherein the second potential difference is smaller than the first potential difference within a range of 10 to 50% of the first potential difference.

6. The image forming apparatus according to claim 1, wherein the second image is formed immediately after the first image is formed.

7. The image forming apparatus according to claim 1, wherein potential of the developer bearing member when forming the first image is the same as when forming the second image.

8. The image forming apparatus according to claim 1, wherein potential of an area exposed by exposure means on a surface of the image bearing member when forming the first image is the same as when forming the second image.

9. The image forming apparatus according to claim 1, further comprising a second voltage application portion configured to apply a voltage to the developer bearing member, wherein the control portion implements control to the second voltage application portion such that an absolute value of a voltage applied to the developer bearing member when forming the second image is larger than an absolute value of a voltage applied to the developer bearing member when forming the first image.

10. The image forming apparatus according to claim 1, wherein the image bearing member and the charging member are rotary bodies configured to rotate in mutually opposite directions, and a moving speed of a surface of the charging member is relatively faster than a moving speed of a surface of the image bearing member.

11. The image forming apparatus according to claim 1, wherein the transfer portion comprises a transfer member configured to transfer a developer image from the image bearing member to a recording material.

12. The image forming apparatus according to claim 1, which is so configured to be able to execute a single-surface image formation mode for forming on a recording material only the first image, and a both-surface image formation mode for forming on the recording material both of the first image and the second image, the image forming apparatus further comprising an operation portion configured to allow a user to specify either of the modes, wherein, when a mode specified by the user is the both-surface image formation mode, the second potential difference is smaller than the first potential difference.

13. The image forming apparatus according to claim 1, wherein the developer is a mono component developer.

* * * * *